US006374945B1

(12) United States Patent
Sherwood

(10) Patent No.: US 6,374,945 B1
(45) Date of Patent: Apr. 23, 2002

(54) FALL PREVENTION SYSTEM

(75) Inventor: Clifford Sherwood, Leeds (GB)

(73) Assignee: Tankersafe Limited et al., Bradford (GB)

( * ) Notice: Subject to any disclaimer, the term of this patent is extended or adjusted under 35 U.S.C. 154(b) by 0 days.

(21) Appl. No.: 09/445,920

(22) PCT Filed: Jun. 18, 1998

(86) PCT No.: PCT/GB98/01623

§ 371 Date: Mar. 10, 2000

§ 102(e) Date: Mar. 10, 2000

(87) PCT Pub. No.: WO98/58703

PCT Pub. Date: Dec. 30, 1998

(30) Foreign Application Priority Data

Jun. 20, 1997 (GB) ..... 9713024

(51) Int. Cl.[7] ..... A62B 35/00
(52) U.S. Cl. ..... 182/3; 182/36
(58) Field of Search ..... 182/3, 4, 6, 36; 224/195, 667; 2/319, 317, 315

(56) References Cited

U.S. PATENT DOCUMENTS 1,486,449 A * 3/1924 Panos
2,879,830 A * 3/1959 Johnson ..... 182/9
3,004,519 A * 10/1961 Weissman
4,991,689 A * 2/1991 Cole ..... 182/3
5,081,719 A * 1/1992 Donnelly
5,287,943 A * 2/1994 Bell ..... 182/3
5,409,195 A * 4/1995 Strickland ..... 182/3
5,509,498 A * 4/1996 Higaki ..... 182/3
5,722,576 A * 3/1998 Rogers

FOREIGN PATENT DOCUMENTS

DE 1092353 * 11/1960
DK 72350 * 4/1951 ..... 182/4
FR 2637505 * 4/1990

* cited by examiner

*Primary Examiner*—Alvin Chin-Shue
(74) *Attorney, Agent, or Firm*—Howard & Howard

(57) ABSTRACT

The present invention relates to a fall-prevention system comprising a padded belt (10) having a pair of runners (11) carrying running rings (12) to which is attached a karabiner (14) which is connected by a pair of lanyards (15, 16) to a pair of tensioned wires (18, 19). The running rings (12) enable a user to rotate freely while remaining secure to the tensioned safety wires (18, 19) by means of the lanyards (15, 16) while also being able to move along a walkway (20).

2 Claims, 3 Drawing Sheets

FALL PREVENTION SYSTEM

The present invention relates to a safety system for use with elevated access areas such as aerial walkways, for example, as can be found on rail or road tankers, having a walkway on the upper surface thereof. Of course, such may be utilised for other types of elevated areas or walkways where safety rails or the like cannot be readily provided.

In general, where walkways are provided in exposed locations, safety devices are required to prevent a user from falling ans sustaining serious injury. Generally speaking, a safety rail can be provided for such purpose. However, there are instances, for example, on the top of tanks or the like, for example, on road tankers or rail tankers, where it is not easily possible to provide appropriate safety rails due to the expense or possible height restrictions. Such arrangements also assume that the operator is conscious and able to reach for a hand-hold.

It is the object of the present invention to provide a fall-prevention system for use with aerial walkways, more particularly for use with vehicle tankers and the like, which provides an operative with a simple and secure safety system enabling him to mount a vehicle or walkway and be able to carry out his duties safely and without fear of a fall, even if rendered unconscious.

According to the present invention there is provided a fall-prevention system comprising:

a belt or harness, having at least one runner provided thereon and an attachment coupling slidably retained on the or each runner for attachment, in use, to a clip or karabiner to which is also connected one or more lanyards, the remote ends of which are slidable attached to respective fixed runners securely mounted adjacent to and substantially parallel with an elevated area or walkway.

The fixed runners may comprise, for example, tensioned safety wires, tubes or rails.

Preferably two runners are provided on the belt overlapping one another and extending through more than 180°, each of said runners having a running ring or coupling secured thereon for receiving said clip or karabiner, although a single runner extending through at least 180° may also be employed. The belt is preferably of a broad construction, having padding to protect the wearer's back and to render such reasonably comfortable to wear. The belt, for example, would be constructed of a polyester webbing having a breading strain of in the region of 2500 kg whilst the runners mounted thereon would also be made of polyester, each having a 2000 kg breading strain. These are the preferred strengths and materials concerned, but may be adapted according to circumstances. The running rings and security clip or karabiner and the tensioned wires are all preferably constructed of stainless steel. Where a single lanyard is employed, it preferably has stops to restrict its degree of movement relative to the clip or karabiner.

The present invention will now be described further, by way of example, with reference to the accompanying drawings, in which.

Figure 1:
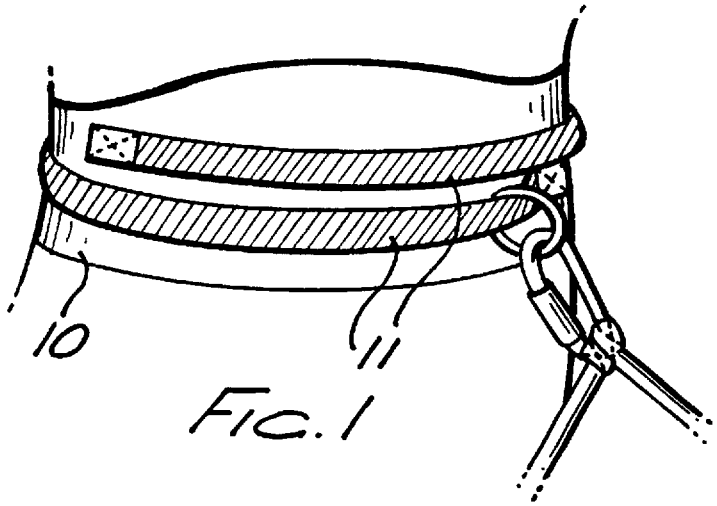
FIG. 1 illustrates a rear view of a belt worn according to the present invention.
Figure 2:
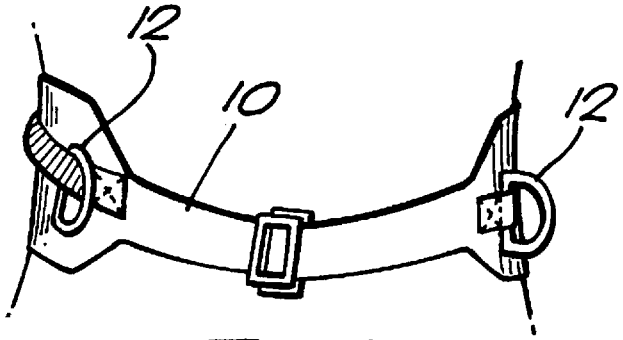
FIG. 2 illustrates a front view of a belt as worn according to the present invention.

Referring to the drawings and in particular FIGS. 1 to 5, a lightweight padded belt 10, for example, of polyester webbing preferably having a 2500 kg breaking strain is provided which is wearable around the user's waist and is padded for comfort. The belt could also form part of a full body harness, if required.

In the preferred embodiment, two runners 11 are provided, each of which supports a stainless steel ring 12 which are free-running along their respective runners 11.

Figure 3:
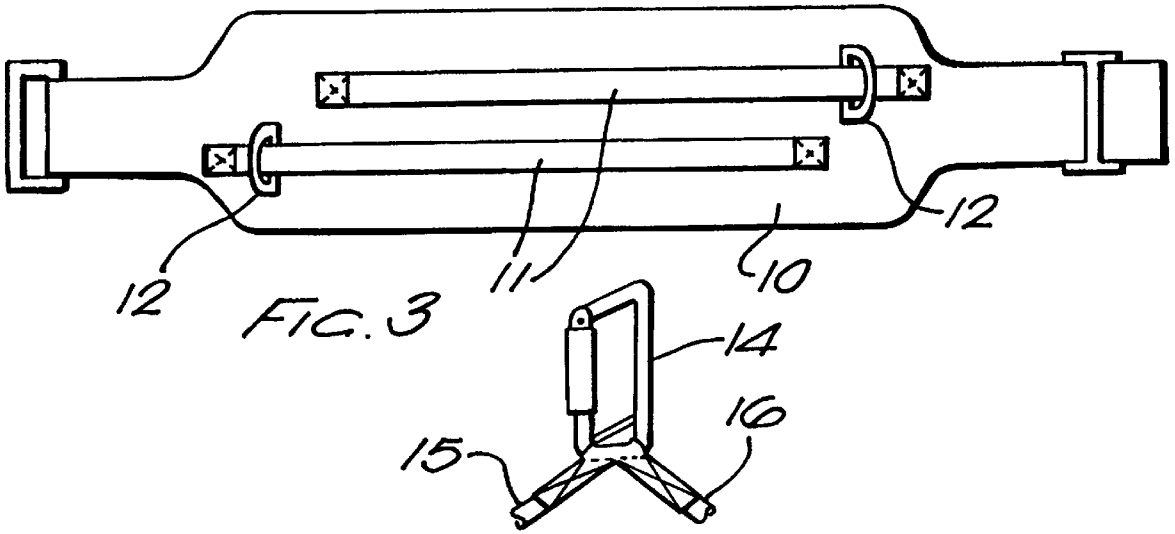
FIG. 3 illustrates the belt and the security clip/karabiner and lanyards of the present invention.

As can be seen in FIG. 3, the runners 11 overlap one another to a large extent, and a security clip, such as a karabiner 14, is removably attachable to one of the respective running rings 12. The karabiner 14 also is connected to a pair of adjustable lanyards 15 and 16 which are connected at their remote ends to fixed runners in the form of tensioned stainless steel wires 18 and 19 securely mounted on either side of a walkway 20 (see FIG. 4). Once connected and adjusted, the operative may rotate through 180°, so that he is able to walk up and down the walkway 20 with the lanyards 15 and 16 running freely along the tensioned wires 18 and 19. However, due to the provision of the lanyards 15 and 16, if the wearer were to fall or stumble, such would prevent him from falling, even if rendered unconscious, without the need of a separate handrail or safety rail.

Figure 6:
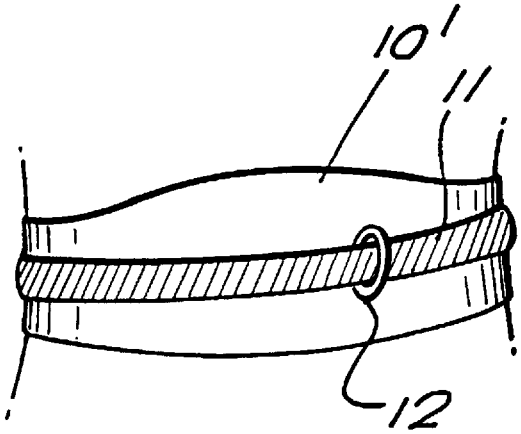
FIG. 6 is a similar view to FIG. 1 of a second embodiment of the invention.
Figure 7:
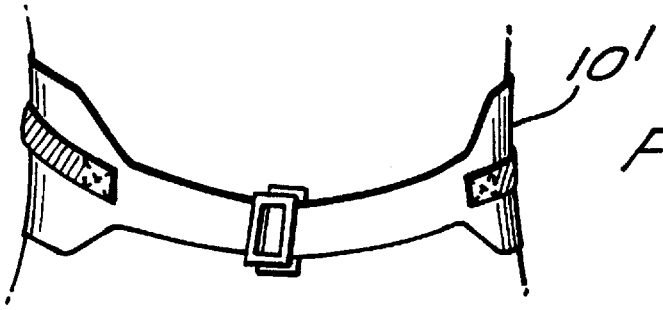
FIG. 7 is a similar view to FIG. 2 of the second embodiment.
Figure 8:
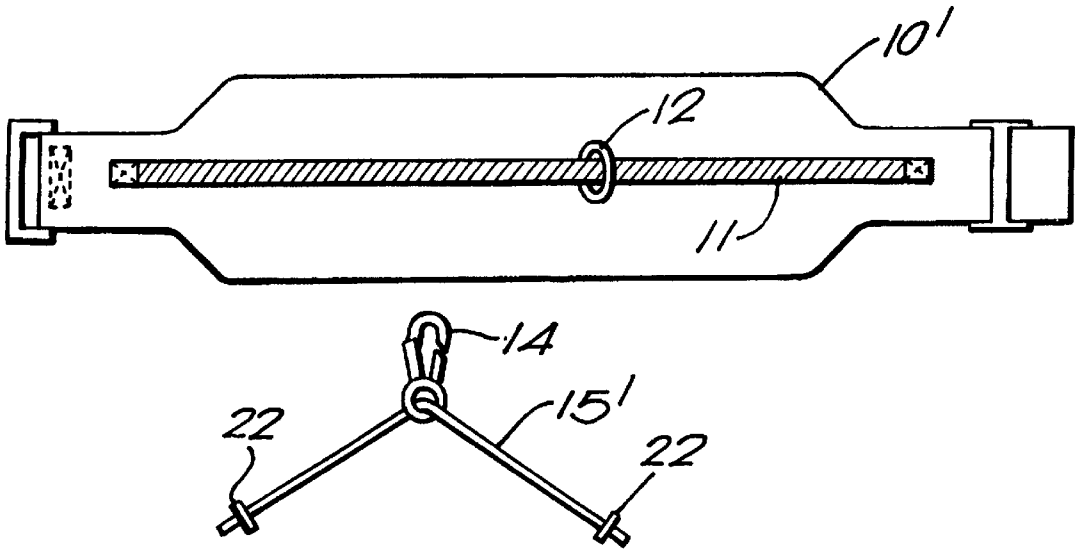
FIG. 8 is a similar view to FIG. 3 of the second embodiment.
Figure 4:
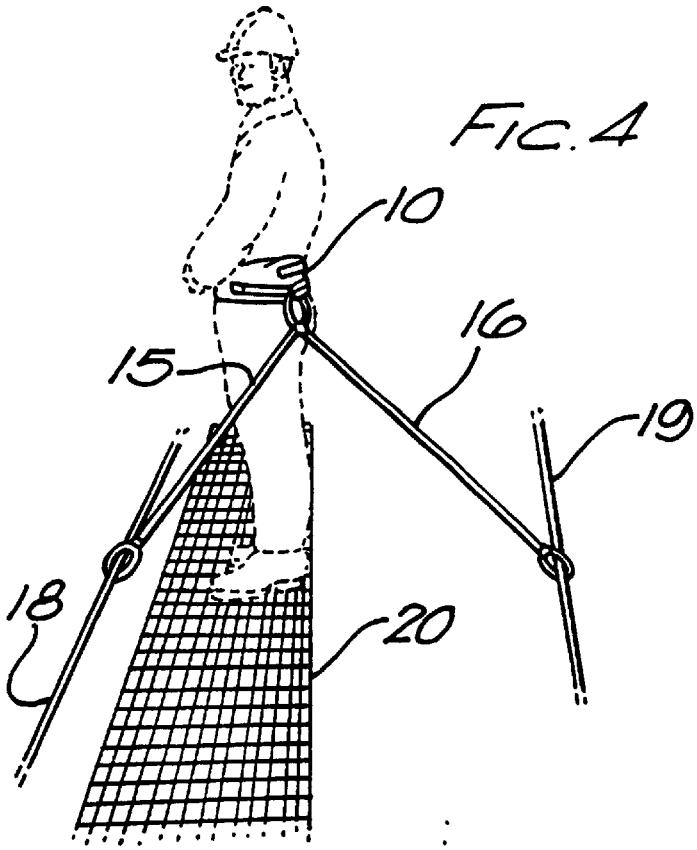
FIG. 4 illustrates a belt worn in use with the lanyards secure to tensioned wires.
Figure 5:
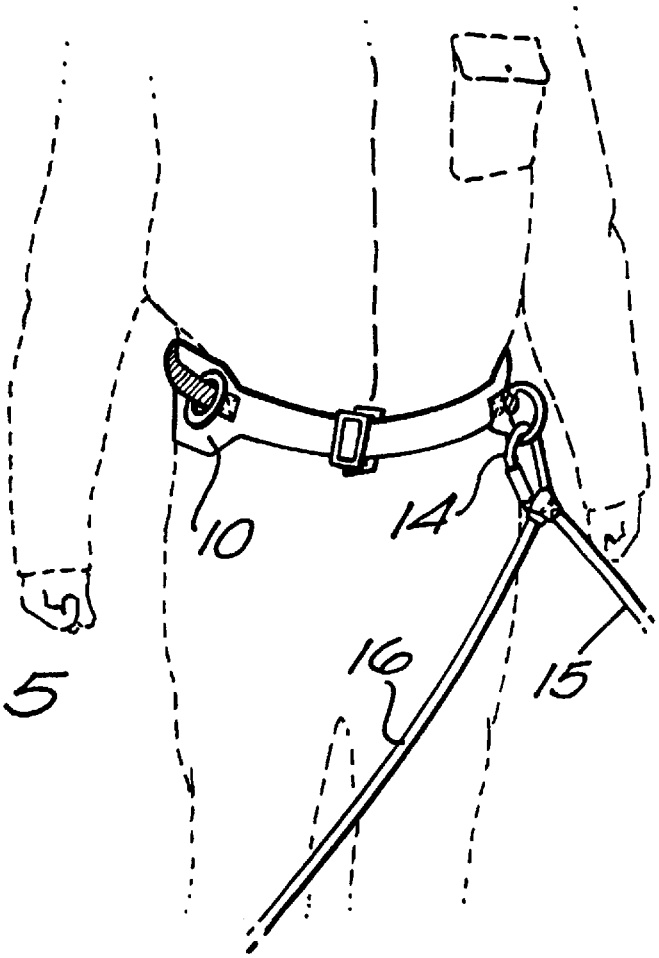
FIG. 5 illustrates the system of the present invention illustrating the extent of movement available to an operative.

Referring now to FIGS. 6 to 8, a second embodiment is illustrated, and like numerals are used for like parts. The belt 10' has a single runner 11 carrying a ring 12. A security clip or karabiner 14 attaches to the ring 12 as before.

In this case a single lanyard 15' is provided, secured to the fixed runners at its remote ends as before. In order to prevent the operative falling too far if he should stumble, stops 22 are fitted to the lanyard 15'. The stops will not pass through the clip or karabiner 14 and so restrict the relative movement between the belt 10' (and thus the operative) and the lanyard 15'.

In use, the operative would attach the safety belt around his waist and then, upon mounting the ladder to climb onto the walkway in question, would connect the karabiner and climb the ladder onto the walkway, adjusting the lanyards accordingly. The operative could then walk along the walkway to perform his tasks and then turn around through 180° and then walk back along the walkway to the ladder and disconnect the karabiner 14 upon descending. At no time would the operative need to disconnect from the system while on the walkway. Although there are two lanyards in the embodiment of FIGS. 1 to 3, they are each connected to a single karabiner 14 which is in turn attached to one of the rings 12. Which is used is a matter of choice, depending on which side the operative wants more freedom of movement; this may even be determined by whether the operative is left- or right-handed. The embodiment of FIGS. 6 to 8 is not handed, and the single runner 11 extends across virtually the entire width of the belt 10'. This belt could also be used with the lanyard system of FIG. 3.

The safety wires comprising tensioned steel wires 18 and 19 are preferably permanently attached to brackets mounted either side of a walkway 20, for example, on a vehicle tanker or the like, but such do not need to be mounted at a hand-hold height, and are attached by simple brackets welded to either side of the walkway 20. Such are reasonably easy and inexpensive to install and may be left permanently in position without adding height to, for example, a vehicles, where such may be of importance. Alternatively, rigid tubes, rails or the like could be provided for the lanyards to run on.

What is claimed is:

1. A fall prevention system comprising;

a belt for surrounding a waist, a first runner on said belt, an attachment coupling slidably retained on said runner, a clip connected to said coupling, a pair of first and second spaced rails fixed to a structure on either side of an elevated walkway, first and second lanyards connected at first ends thereof to said clip and second ends slidably attached to said rails whereby the lanyard connected to said first rail will limit movement of said belt over said second rail and said second rail will limit movement of said belt over said first rail.

2. A fall prevention system comprising;

a belt for surrounding a waist, a first runner on said belt and extending substantially around said belt when said belt is disposed in surrounding relationship to a waist, a second runner on said belt and extending substantially around said belt when said belt is disposed in surrounding relationship to a waist;

said first and second runners having overlapping portions disposed in overlapping relationship with one another with each runner having an end portion extending beyond said overlapping portions, a first attachment coupling slidably retained on said first runner, and a second attachment coupling slidably retained on said second runner.

* * * * *